US012686520B2

(12) United States Patent
Mrowka et al.

(10) Patent No.: US 12,686,520 B2
(45) Date of Patent: Jul. 21, 2026

(54) DEVICE FOR SHRINKING HEAT-SHRINK FILM PLACED AROUND PALLETIZED STACK OF GOODS, AND METHOD FOR SHRINKING HEAT-SHRINK FILM PLACED AROUND PALLETIZED STACK OF GOODS

(71) Applicant: MSK—Verpackungs-Systeme GmbH, Kleve (DE)

(72) Inventors: Christian Mrowka, Hünxe (DE); Enrico Czok, Kleve (DE); Michael Oymann, Xanten (DE); Reiner Hannen, Kalkar (DE); Uwe Jonkmanns, Goch (DE)

(73) Assignee: MSK—Verpackungs-Systeme GmbH, Kleve (DE)

( * ) Notice: Subject to any disclaimer, the term of this patent is extended or adjusted under 35 U.S.C. 154(b) by 0 days.

(21) Appl. No.: 18/953,197

(22) Filed: Nov. 20, 2024

(65) Prior Publication Data

US 2025/0162753 A1 May 22, 2025

(30) Foreign Application Priority Data

Nov. 22, 2023 (DE) ..... 202023106879.0

(51) Int. Cl.
*B65B 53/06* (2006.01)

(52) U.S. Cl.
CPC ..... *B65B 53/066* (2013.01)

(58) Field of Classification Search
CPC ..... B65B 59/001; B65B 53/02; B65B 9/135; B65B 53/066
See application file for complete search history.

(56) References Cited

U.S. PATENT DOCUMENTS 3,621,588 A * 11/1971 Grocke ..... B65B 53/06 53/442
4,562,689 A * 1/1986 Hannen ..... B65B 53/066 53/442

(Continued)

FOREIGN PATENT DOCUMENTS

EP 0285855 B1 8/1992
EP 2825468 B1 11/2016

OTHER PUBLICATIONS

International Search Report from corresponding European Patent Application No. 24213828.7-1014 dated Apr. 14, 2025.

*Primary Examiner* — Andrew M Tecco
*Assistant Examiner* — Nicholas E Igbokwe
(74) *Attorney, Agent, or Firm* — CALDERON SAFRAN & WRIGHT P.C.

(57) ABSTRACT

A device for shrinking a heat-shrink film placed around a palletized stack of goods includes a shrinking frame movable on a rack in vertical direction and forming an opening for the stack of goods. A shrinking device for shrinking the heat-shrink film includes a surrounding side wall, forming a shrinking space, comprising a shrink hood open downward and a cover. The shrink hood is movable in the vertical direction, and includes a blower that generates an air flow in the interior of the shrink hood. The blower includes an impeller driven by a drive. At least one air-guide section includes a nozzle on its end opposite the impeller, so that the air suctioned by the impeller from the shrinking space surrounded by the shrink hood can be reintroduce in a directed manner via the nozzle into the shrinking space surrounded by the shrink hood.

25 Claims, 10 Drawing Sheets

(56) References Cited

U.S. PATENT DOCUMENTS

| | | | | |
|---|---|---|---|---|
| 4,597,193 | A * | 7/1986 | Kallfass | B65B 53/063 34/224 |
| 5,502,947 | A * | 4/1996 | Birkenfeld | B65B 53/066 53/442 |
| 6,584,752 | B1 * | 7/2003 | Herava | B65B 11/585 53/399 |
| 6,837,031 | B1 * | 1/2005 | Hannen | B65B 53/066 53/442 |
| 7,703,263 | B2 * | 4/2010 | Reiner | B65B 53/066 53/442 |
| 2008/0202072 | A1 * | 8/2008 | Reiner | B65B 53/066 53/442 |
| 2014/0157724 | A1 * | 6/2014 | Hannen | B65B 11/585 53/442 |
| 2014/0366488 | A1 * | 12/2014 | Vermeulen | B65B 53/02 53/442 |
| 2018/0111774 | A1 * | 4/2018 | Hannen | B65H 18/026 |

* cited by examiner

DEVICE FOR SHRINKING HEAT-SHRINK FILM PLACED AROUND PALLETIZED STACK OF GOODS, AND METHOD FOR SHRINKING HEAT-SHRINK FILM PLACED AROUND PALLETIZED STACK OF GOODS

CROSS-REFERENCE TO RELATED APPLICATIONS AND CLAIM TO PRIORITY

This application is related to patent application no. 20 2023 106 879.0 filed Nov. 22, 2023 in Germany, the disclosure of which is incorporated herein by reference and to which priority is claimed.

FIELD OF THE INVENTION

The invention relates to a device for shrinking a heat-shrink film placed around a preferably palletized stack of goods that has a shrinking frame forming an opening for the stack of goods, which is movable in vertical direction on a rack, between an upper position and a lower position, on which shrinking frame at least one shrinking device is provided for shrinking the heat-shrink film by heating, the device including a shrink hood, open downward, forming a shrinking space above the shrinking frame, comprising an encircling side wall and a cover in which the shrink hood is movable in vertical direction, the device furthermore including at least one blower generating an air flow in the interior of the shrink hood, the at least one blower including an impeller driven by a drive.

BACKGROUND OF THE INVENTION

From practice, devices are known for shrinking a heat-shrink film placed on a stack of goods, said devices comprising a shrink hood. Using a blower, the air present in the shrink hood is circulated in order to achieve a uniform temperature level inside the shrink hood. In this respect the blower allows only a circulation of the air present in the shrink hood.

SUMMARY OF THE INVENTION

The object of the invention is to avoid the disadvantage cited above and specify a device that enables targeted heat-impinging of individual regions of the heat-shrink film in the interior of the shrink hood.

This object is achieved with a generic device in that at least one air-guide section is connected to the impeller of at least one blower, the air-guide section including at least one nozzle on its end opposite the impeller, so that the air in the shrinking space enclosed by the shrink hood, which is suctioned out by the impeller, can be reintroduced in a targeted manner, via the at least one nozzle, into the shrinking space enclosed by the shrink hood.

Each air-guide section connecting to the impeller forms, with the at least one nozzle, an air channel through which flows the heated air suctioned out by the blower. The nozzle focuses the air flow generated by the respective blower onto a specific region of the heat-shrink film. The heated air volume is removed by the blower from the heated shrinking space above the stack of goods, and after flowing through the air-guide section, is blown out in a targeted and thus directed fashion. The direction of the air flow is set in a targeted manner in order to heat individual regions of the heat-shrink film on the surface of the stack of goods, and thus shrink the corresponding region of the heat-shrink film.

In focus here in particular are regions in which a plurality of film layers are to be connected. These can, for example, be regions in which an outer film and a wrapper film overlap. In this manner, good packaging with high loading stability is achieved for the packaged product. In this way, the air is suctioned by the impeller out of the region above the stack of goods and blown in again, in a targeted manner, via the at least one nozzle, into the shrinking space enclosed by the shrink hood.

In one possible mode of operation of the invention, the shrinking frame, and thus also the shrink hood, are located in the upper position. The shrinking space is heated using the shrinking devices. Then, or also beforehand, for example using a conveyor, the stack of goods is moved with the heat-shrink film and possibly an applied wrapper film already provided, until the stack of goods is located centered below the shrinking frame and the shrink hood. Then the shrinking frame, and thus also the shrink hood, is moved downward into its lower position. As a result, the shrink hood with the heated shrinking space settles over the stack of goods. Here, through each nozzle, an air flow that has been generated by the respective blower is directed onto the desired surface section of the stack of goods. When the shrinking frame and the shrink hood have reached their lower position, the shrinking process is finished. The shrinking frame and the shrink hood are again moved into their upper position, and the stack of goods with the shrunk-on heat-shrink film is conveyed onward.

The shrinking frame is usually comprised of four frame parts forming a rectangular opening. The shrinking space encompassed by the shrink hood is enlarged by the shrinking frame disposed below the shrink hood. The shrink hood is preferably directly connected with the shrinking frame, for example, with the top side of the shrinking frame, or placed on the shrinking frame. Here, shrink hood and shrinking frame can be connected with each other in an airtight manner. The shrink hood is preferably comprised of a thermally insulating housing. The at least one shrinking device can be configured, for example, as an electrically driven shrinking device. Other types of shrinking device are also possible. Thus the shrinking device can also be gas-powered, for example.

The drive of each blower is preferably disposed outside the shrink hood, while the impeller is disposed in the interior of the shrink hood. With such an arrangement, on the one hand, installation space can be saved in the interior of the shrink hood. On the other hand, the drive is not subjected to the high operating temperatures in the interior of the shrink hood.

It is furthermore possible for the entire blower to be disposed inside the shrinking housing. However, it is also conceivable that the blower is disposed outside the shrink hood, and the air is suctioned from the interior of the shrink hood via an opening in the cover. An air-guide section can be disposed inside or outside the shrink hood.

Advantageously at least one nozzle can be formed as a slotted nozzle. The slotted nozzle preferably extends from one side of the shrink hood up to the opposite side of the shrink hood, and thus over the entire edge of a stack of goods to be shrink-wrapped. The edge can then be heated uniformly over its entire length. With a slotted nozzle, a linear jet of ejected air is achieved, which can be optimally directed, for example, onto an edge. The heated air is not guided only onto a circumscribed region of the heat-shrink film but rather over the entire length of the edge of the stack of goods.

In addition, at least one blower can be configured as a radial blower. This embodiment makes it possible to arrange the blower, or at least the impeller of the blower, in the interior of the shrink hood, even when there is limited installation space available.

Furthermore the impeller of at least one blower, as well as the air-guide section emanating from this impeller, can be attached below the cover of the shrink hood, or indirectly or directly attached to the inside of the cover of the shrink hood. With an arrangement of the impeller below the cover of the shrink hood, the particularly warm air in the upper region of the shrink hood, that is under the cover, can be suctioned off and then selectively reintroduced.

Advantageously, in at least one air-guide section, at least one heating element can be provided for heating the air flowing through this air-guide section. Due to the heating element, the air flowing through this air-guide section can be heated to the temperature required for the shrinking. In this respect, due to the nozzle connected to this air-guide section, air with a higher temperature than the temperature generally present in the interior of the shrink hood can be guided in a targeted manner onto the heat-shrink film.

In addition, in at least one blower, the assembly comprised of the impeller, the air-guide section, and the at least one nozzle, can be configured as horizontally movable. With a design of this kind, the entire assembly is moved horizontally.

Alternatively, with at least one blower. the at least one nozzle can be configured as horizontally movable, and the length of the air-guide section can be variable according to the respective position of the at least one nozzle. The nozzle can, for example, be disposed on a carriage that is movable along at least one track. Other constructive designs are also conceivable. A drive, such as, a linear drive, for example, can be assigned to the wagon. The air-guide section is configured either as flexible, for example as a hose, or as at least longitudinally flexible, for example as telescopable.

With at least one housing, at least one nozzle can advantageously be vertically movable. The nozzle can be disposed, for example, on a carriage transportable along a rail. A drive, preferably a linear drive, can be associated with the carriage. If the air-guide section and the impeller are not also vertically transportable together with the nozzle, the air-guide section can be configured as flexible, for example, as a hose, or as longitudinally flexible, for example as telescopable.

In addition, with at least one blower, at least one nozzle can be disposed as swivelable about a horizontal axis. This nozzle can be configured as swivelable with a drive, for example, a pneumatic or electric drive. Thus, even with different dimensions of a stack of goods, the respective nozzle can be, for example, optimally directed onto an edge of the stack of goods. This proves an advantage when an increased amount of heat is required to shrink multiple layers in the region of an edge.

Furthermore, the device can include a closure surface which, with respect to its contour and dimensions, is adapted to the contour and the dimensions of the opening of the shrinking frame, such that the closure surface on the one hand, and the shrinking frame and the shrink hood on the other hand, are movable relative to each other, so that when the shrinking frame is located in its upper position, the closure surface is disposed inside the opening, preferably stationarily, so that with increasing movement of the shrinking frame into its upper position the closure surface moves closer to the cover of the shrink hood. The closure surface includes feet, for example, its underside standing on the base. Alternatively it can be attached using rods, for example to a crossbar of the rack. In this case, the rods extend through the cover of the shrink hood. With respect to its contour and dimensions, the closure surface is adapted to the opening, such that between the outer edge of the closure surface and the inner edge of the opening, a gap still remains, so that the closure surface can be moved with respect to the opening, for example in a contact-free manner. The closure surface reduces heat loss when the shrinking frame is located in its upper position. The closure surface is arranged at such a height that, on the one hand, it is above the stack of goods, and on the other hand, it essentially closes off the shrinking frame on its underside. Consequently, due to the closure surface, the open area inside the shrinking frame, and thus the shrinking space of the shrink hood, can be nearly closed off, except in the region of the above-described gap. In this way, closing the shrink hood or the shrinking frame can significantly reduce the energy consumption of the device.

The height of the shrinking space can advantageously be at least 300 mm higher than the height of a stack of goods to be packaged. The shrinking space is enlarged by the shrinking frame disposed below the shrink hood. Thus when the shrinking frame with the shrink hood is located in its lower position, a spacing of at least 300 mm remains between the top side of the stack of goods and the underside of the cover, so that the air in the shrinking space enclosed by the shrink hood, which is suctioned out by the impeller, can be reintroduced, in a directed manner via the at least one nozzle into the shrinking space enclosed by the shrink hood.

In addition, the shrink hood can be connected with the shrinking frame, preferably in an airtight manner. With such a design, the shrink hood is moved vertically together with the shrinking frame. "Connected" is understood to mean, for example, a design in which the shrink hood, for example, is screwed, riveted, or welded directly onto the shrinking frame. "Connected" is also understood to mean, for example, a variant in which, for example, sections of the shrinking frame also form the side parts of the shrink hood. The shrink hood can advantageously be connected with the shrinking frame in an airtight manner.

When there is at least one blower, the impeller can be enclosed in a housing that has a suction opening, at least one ventilation section being connected to the housing.

The invention also relates to a method for shrinking a heat-shrink film placed around a preferably palletized stack of goods, preferably using a device with a shrinking frame that forms an opening for the stack of goods, said shrinking frame being movable on a rack in vertical direction between an upper position and a lower position, on which shrinking frame at least one shrinking device for the shrinking of the heat-shrink film by heating is provided, the device including a shrink hood, open downward, said shrink hood forming a shrinking space above the shrinking frame comprising an encircling side wall and a cover within which the shrink hood is moved in vertical direction, the device furthermore including at least one blower that generates an air flow in the interior of the shrink hood, the at least one blower including an impeller driven by a drive, particularly preferably using a device according to one of the embodiments described above.

From practice, devices are known for shrinking a heat-shrink film placed on a stack of goods, said devices comprising a shrink hood. Using a blower, the air located in the shrink hood is circulated in order to achieve a uniform temperature level inside the shrink hood. Here the blower allows only circulation of the air present in the shrink hood.

The object of the invention is to avoid the abovementioned disadvantage and disclose a method that enables a targeted heat-impinging of individual regions of the heat-shrink film in the interior of the shrink hood.

This object is achieved with a generic method according to which at least one air-guide section is connected to the impeller of at least one blower; the air-guide section including at least one nozzle on its end opposite the impeller, so that the air in the shrinking space enclosed by the shrink hood that is suctioned out by the impeller can be reintroduced in a targeted manner, via the at least one nozzle, into the shrinking space enclosed by the shrink hood.

Each air-guide section that is connected to the impeller forms, with the at least one nozzle, an air channel through which flows the heated air suctioned out by the blower. The nozzle focuses the airflow generated by the respective blower onto a certain region of the heat-shrink film. Here the heated volume of air is removed via the blower from the heated shrinking space above the stack of goods, and after flowing-through the air-guide section, blown out in a targeted and thus directed manner. The direction of the airflow is set in a targeted manner in order to heat individual regions of the heat-shrink film on the surface of the stack of goods, and thus shrink the corresponding region of the heat-shrink film. In focus here are, in particular, regions in which a plurality of film layers are to be connected. These can be, for example, regions in which an outer film and a wrapper film overlap. In this manner a good packaging result with high loading stability of the packaged product is achieved. The air is suctioned by the impeller out of the region above the stack of goods and blown again, in a directed manner, via the at least one nozzle, into the shrinking space enclosed by the shrink hood.

In one possible mode of operation of the invention, the shrinking frame and thus also the shrink hood are located in the upper position. The shrinking space is heated using the shrinking devices. Then, or also beforehand, for example, using a conveyor, the stack of goods, with the heat-shrink film already provided and a possibly applied wrapper film, is moved until the stack of goods is located centered below the shrinking frame and the shrink hood. Then the shrinking frame, and thus also the shrink hood, is moved downward into its lower position. Then the shrink hood with the heated shrinking space is lowered over the stack of goods. Then an air flow that has been generated by the respective blower is directed by each nozzle specifically onto the desired surface section of the stack of goods. When the shrinking frame and the shrink hood have reached their lower position, the shrinking process is concluded. The shrinking frame and the shrink hood are moved back into their upper position, and the stack of goods with the shrunk-on heat-shrink film is conveyed onward.

The shrinking frame is usually comprised of four frame parts that form a rectangular opening. The shrinking space comprised by the shrink hood is enlarged by the shrinking frame disposed below the shrink hood. The shrink hood is preferably directly connected with the shrinking frame, for example, with the top side of the shrinking frame, or placed on the shrinking frame. Here, shrink hood and shrinking frame can be connected to each other in an airtight manner. The shrink hood is preferably comprised of a thermally insulating housing. The at least one shrinking device can be configured, for example, as an electrically driven shrinking device. Other types of shrinking device are also possible. Thus, the shrinking device can also be gas-powered, for example.

The drive of each blower is preferably disposed outside the shrink hood, while the impeller is disposed in the interior of the shrink hood. With such an arrangement, on the one hand, installation space can be saved in the interior of the shrink hood. On the other hand, the drive is not subjected to the high operating temperatures in the interior of the shrink hood.

It is furthermore possible that the entire blower is disposed inside the shrinking housing. However, it is also conceivable that the blower is disposed outside the shrink hood, and the air is suctioned out of the interior of the shrink hood via an opening in the cover. An air-guide section can be arranged inside or outside the shrink hood.

Advantageously the air in the shrinking space enclosed by the shrink hood that is suctioned out by the impeller can be reintroduced into the shrinking space enclosed by the shrink hood via the at least one nozzle formed as a slotted nozzle. Here the slotted nozzle preferably extends from one side of the shrink hood up to the opposite side of the shrink hood, and thus over the entire edge of a stack of goods to be shrunk. In this way, the edge can be heated uniformly over its entire length. With a slotted nozzle, a linear jet of air is produced, which can be optimally directed, for example, onto an edge. The heated air is not guided solely onto a circumscribed region of the heat-shrink film, but rather over the entire length of the edge of the stack of goods.

In addition, with at least one blower, the assembly comprised of the impeller, the air-guide section, and the at least one nozzle, can be moved horizontally. With such a design, the entire assembly is moved horizontally.

Alternatively with at least one blower, the at least one nozzle can be moved horizontally, and the length of the air-guide section can be varied according to the respective position of the at least one nozzle. The nozzle can, for example, be disposed on a carriage that can be moved along at least one track. Other constructive designs are also conceivable. A drive, such as, for example, a linear drive, can be assigned to the wagon. The air-guide section is configured either as flexible, for example, as a hose, or at least as longitudinally flexible, for example as telescopable.

With at least one housing, at least one nozzle can advantageously be moved vertically. The nozzle can be disposed, for example, on a carriage that is conveyed along a rail. A drive, preferably a linear drive, can be assigned to the carriage. If the air-guide section and the impeller cannot also be moved vertically together with the nozzle, the air-guide section can be configured as flexible, for example, as a hose, or as longitudinally flexible, for example, as telescopable.

In addition, with at least one blower, at least one nozzle can be swiveled around a horizontal axis. This nozzle can be configured as swivelable with a drive, for example, a pneumatic or electric drive. Thus, even with other dimensions of a stack of goods, the respective nozzle can, for example, be optimally directed at an edge of the stack of goods. This proves to be an advantage when in the region of an edge an increased amount of heat is required for the shrinking of multiple layers.

Furthermore, in at least one air-guide section, at least one heating element can be provided, and at least one heating element can heat the air flowing through this air-guide section. Due to the heating element, the air flowing through this air-guide section can be heated to the temperature required for shrinking. In this respect, due to the nozzle connected to this air-guide section, air with a higher temperature than the temperature generally present in the interior of the shrink hood can be guided in a targeted manner onto the heat-shrink film.

The device can advantageously include a closure surface which, with respect to its contour and dimensions, is adapted to the contour and the dimensions of the opening of the shrinking frame, such that the closure surface on the one hand, and the shrinking frame and the shrink hood on the other hand, are moved relative to each other, so that when the shrinking frame is located in its upper position, the closure surface is disposed inside the opening, preferably stationarily, so that with increasing movement of the shrinking frame into its upper position, the closure surface comes closer to the cover of the shrink hood. The closure surface has feet, for example, and its underside stands on the base. Alternatively it can be attached, using rods, for example, to a crossbar of the rack. In this case, the rods extend through the cover of the shrink hood. With respect to its contour and dimensions, the closure surface is adapted to the opening such that there is still a gap between the outer edge of the closure surface and the inner edge of the opening, so that the closure surface can be moved with respect to the opening, for example, in a contact-free manner. The closure surface reduces heat loss when the shrinking frame is located in its upper position. The closure surface is disposed at a height which, on the one hand it is above the stack of goods, and on the other hand essentially closes off the shrinking frame on its underside. In this respect, due to the closure surface, the open area encompassed by the shrinking frame, and thus the shrinking space of the shrink hood, can be nearly closed off, except in the region of the above-described gap. In this respect due to the closing of the shrink hood or of the shrinking frame, the energy consumption of the device can be significantly reduced In addition, in the lower position of the shrinking frame, the spacing A between the top side of the stack of goods and the cover of the shrink hood is at least 300 mm. Due to the remaining spacing A of at least 300 mm between the top side of the stack of goods and the underside of the cover in the lower position of the shrinking frame and shrink hood, each impeller can effectively suction out the air present in the shrinking space enclosed by the shrink hood and reintroduce it by blowing, in a targeted manner via the at least one nozzle, into the shrinking space enclosed by the shrink hood shrink hood.

Furthermore, during shrinking, preferably during upper shrink-wrapping, at least one nozzle, preferably formed as a slotted nozzle, is directed onto the adjacent upper edge of the stack of goods. In this manner heat can be introduced in a targeted manner onto the region of the heat-shrink film that extends along the respective edge. This enables, for example, the optimal heat-sealing of the edge region of a heat-shrink banderole with a cover sheet applied to the stack of goods.

Here, during the shrinking, preferably during the upper shrink-wrapping, an air stream is directed respectively onto two opposing upper edges of the stack of goods via at least two opposing nozzles. With this procedure, heat is applied simultaneously in a targeted manner onto the two opposing edges of a stack of goods. These edges are preferably the two longitudinal edges of a stack of goods. If, for example, using a conveyor belt, the stack of goods is moved toward the device, and moved away from it after shrinking, the two longitudinal edges are oriented parallel to the transport direction of the stack of goods.

During shrinking, preferably during the upper shrink-wrapping, at least one nozzle is advantageously set in a pendulum motion about its horizontal axis. Such an operation can be used, for example, when a heat-shrink hood is used as a heat-shrink film. Due to the pendulum motion, the air flow can be guided uniformly from the edge toward the opposing edge of the top side of the stack of goods.

BRIEF DESCRIPTION OF THE DRAWINGS

In the following, exemplary embodiments of the invention shown in the drawings are explained. They show.

DETAILED DESCRIPTION OF THE PREFERRED EMBODIMENT(S)

In all figures, corresponding reference numbers are used for identical or functionally identical components.

Figure 1:
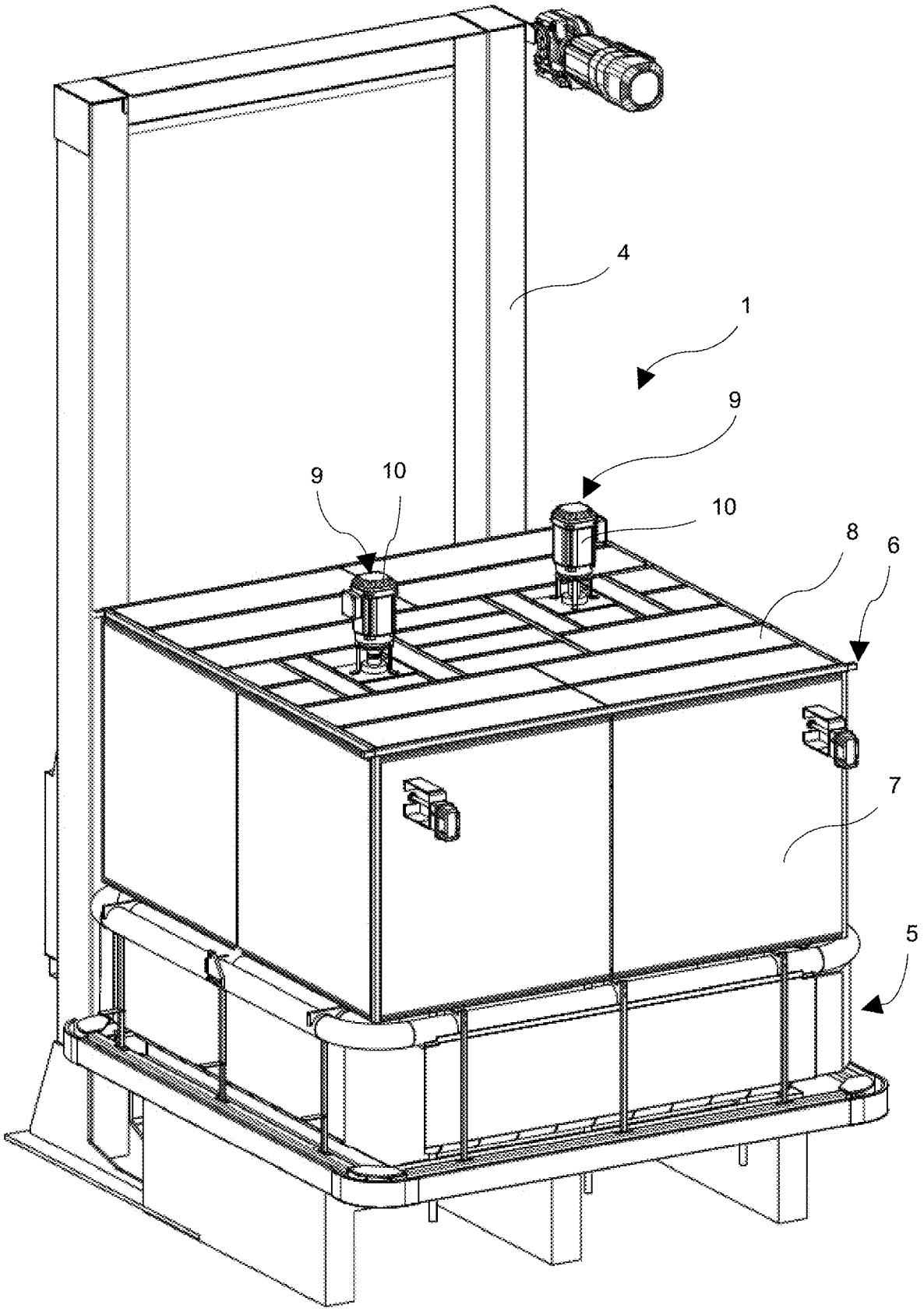
FIG. 1 an oblique view of an exemplary embodiment of an inventive device.

FIG. 1 shows a device 1 for shrinking a not-shown heat-shrink film 3 around a stack of goods 2, also not shown. The device 1 comprises a rack 4 with a shrinking frame 5 movable between an upper position and a lower position. The shrinking frame 5 is comprised of four frame parts forming a rectangular opening 19.

On each frame part, a shrinking device, not shown in this Figure, is provided for shrinking the heat-shrink film 3 by heating. The device 1 also comprises a shrink hood 6, open downward, forming a shrinking space. The shrink hood 6 here is formed with a side wall 7 and a cover 8. In the exemplary embodiment shown, the shrink hood 6 is connected with the shrinking frame 5 and thus forms a unit with the shrinking frame 5. Here, with vertical shifting of the shrinking frame 5 the shrink hood 6 is moved with it. The device 1 further comprises two blowers 9 respectively generating an air flow in the interior of the shrink hood 6, said blowers 9 each including an impeller 20 driven by a drive 10. The impeller 20 of each blower 9 is situated in the interior of the shrink hood 6, while the respective drive 10 is disposed on the outer side of the shrink hood 6. In the exemplary embodiment shown, each impeller 20 is enclosed by a housing 21, each housing 21 having a suction inlet 22 on its underside.

Figure 2:
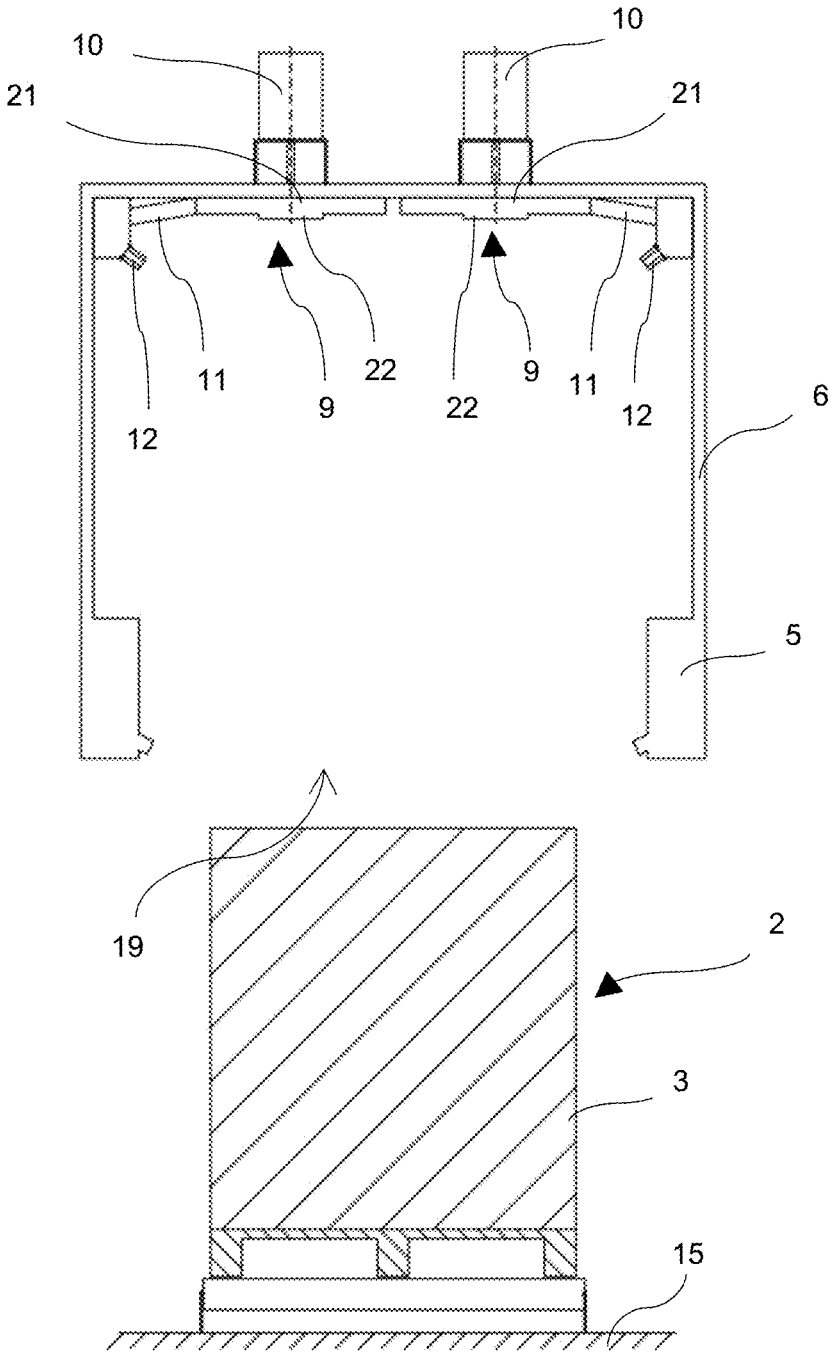
FIG. 2 a sectional view of the object of the invention according to FIG. 1, in which the shrinking frame and the shrink hood are located in the upper position, FIG. 3 the object according to FIG. 2, in which the shrinking frame and the shrink hood are located in the lower position, FIG. 4 a sectional view of an additional exemplary embodiment of the inventive device with a closure surface, in which the shrinking frame and the shrink hood are located in the upper position, FIG. 5 the object according to FIG. 4, in which the shrinking frame and the shrink hood are located in the lower position, FIG. 6 a sectional view of a further exemplary embodiment of the inventive device with a closure surface in which the shrinking frame and the shrink hood are located in the upper position, FIG. 7 the object according to FIG. 6, in which the shrinking frame and the shrink hood are located in the lower position, FIG. 8 a sectional view of a further exemplary embodiment of the inventive device with a closure surface and with swivelable slotted nozzles, in which the shrinking frame and the shrink hood are located in the upper position, FIG. 9 a view of the inner side of a cover of a shrink hood, and FIG. 10 the object according to FIG. 4 with slotted nozzles moved closer together horizontally.

FIG. 2 shows a sectional view of the object according to FIG. 1. The shrink hood 6 is connected with the shrinking frame 5 in an airtight manner. The shrinking frame 5 is located in its upper position. The shrinking frame 5 forms the opening 19 for the stack of goods 2. The stack of goods 2 has an underside, by which the stack of goods 2 is set down on a pallet 23, four side surfaces, and a top side. Furthermore, the stack of goods 2 has an edge 17 at the transition from each side surface to the top side.

The shrinking devices are disposed around the opening 19; in the exemplary embodiment shown, the shrinking devices each include at least one slotted blow-out nozzle 24, which is directed obliquely downward to discharge heated air to shrink the heat-shrink film 3.

The rack 4, not depicted, of the device 1 is located behind the shrink hood 6 or the stack of goods 2, and stands on a base 15. Centered under the shrink hood 6, the stack of goods 2 is depicted with the heat-shrink film 3. On the inner side of the cover 8 the housing 21 is arranged with the respective impeller 20 located therein. An air-guide section 11 respectively connects to each impeller 20, that is, to each housing 21. On its end opposite the impeller 20, each air-guide section 11 respectively includes a nozzle 12.

The air suctioned by the impeller 20 via the respective suction outlet opening 22 out of the shrinking space enclosed by the shrink hood 6 is reintroduced in a targeted manner via the respective nozzle 12 into the shrinking space enclosed by the shrink hood 6. In the position shown, the lower edge of the shrinking frame 5 is higher than the top side of the stack of goods 2. Thus, in the state of motion shown, the shrinking process has not yet begun.

Figure 3:
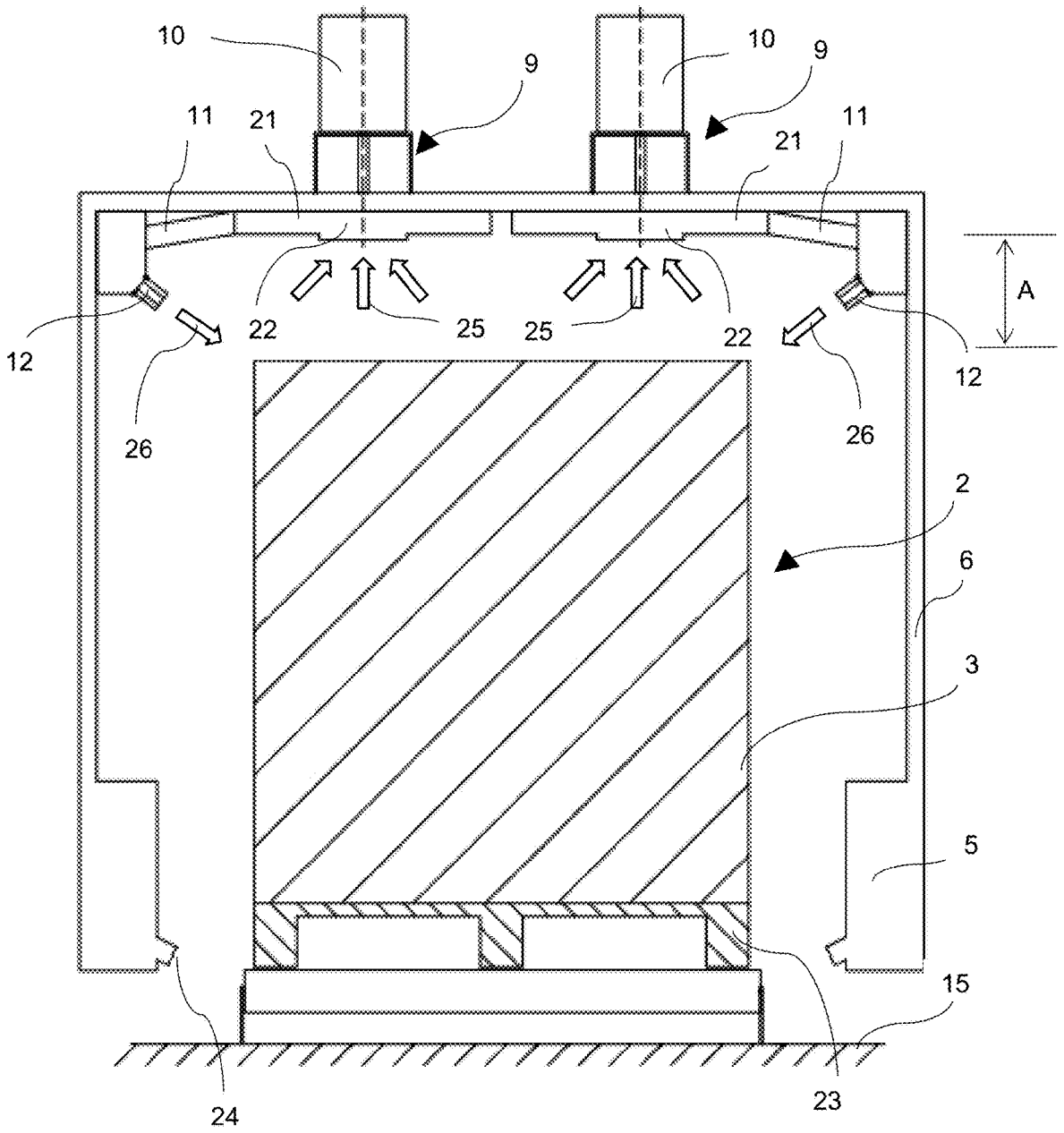

FIG. 3 shows a further state of motion of the object according to FIG. 2. The lower edge of the shrinking frame 5 is now below the stack of goods 2 at the height of a pallet 23. The shrinking frame 5 has accordingly been moved from its upper position into its lower position. In the interior of the shrink hood 6, the heated air discharged by the blow-out nozzles 24 shrinks the heat-shrink foil 3. The blowers 9 simultaneously suction air in the direction of the arrows 25 from the upper region of the shrinking frame into the interior of the shrink hood 6. Via the respective air-guide section 11, the suctioned air is then reintroduced in a targeted manner via the nozzles 12 in the direction of the arrows 26 to the shrinking space enclosed by the shrink hood 6. In the exemplary embodiment shown, each of the two nozzles 12 is configured as a slotted nozzle. The orientation of the slotted nozzles is such that in the lower position of the shrinking frame 5, the discharged air is blown in the direction of the arrows 26 onto the adjacent edges 17 of the stack of goods 2.

As can be seen in FIG. 3, in the lower position of the shrinking frame 5, the spacing A between the top side of the stack of goods 2 and the cover 8 of the shrink hood 6 is at least 300 mm.

Figure 4:
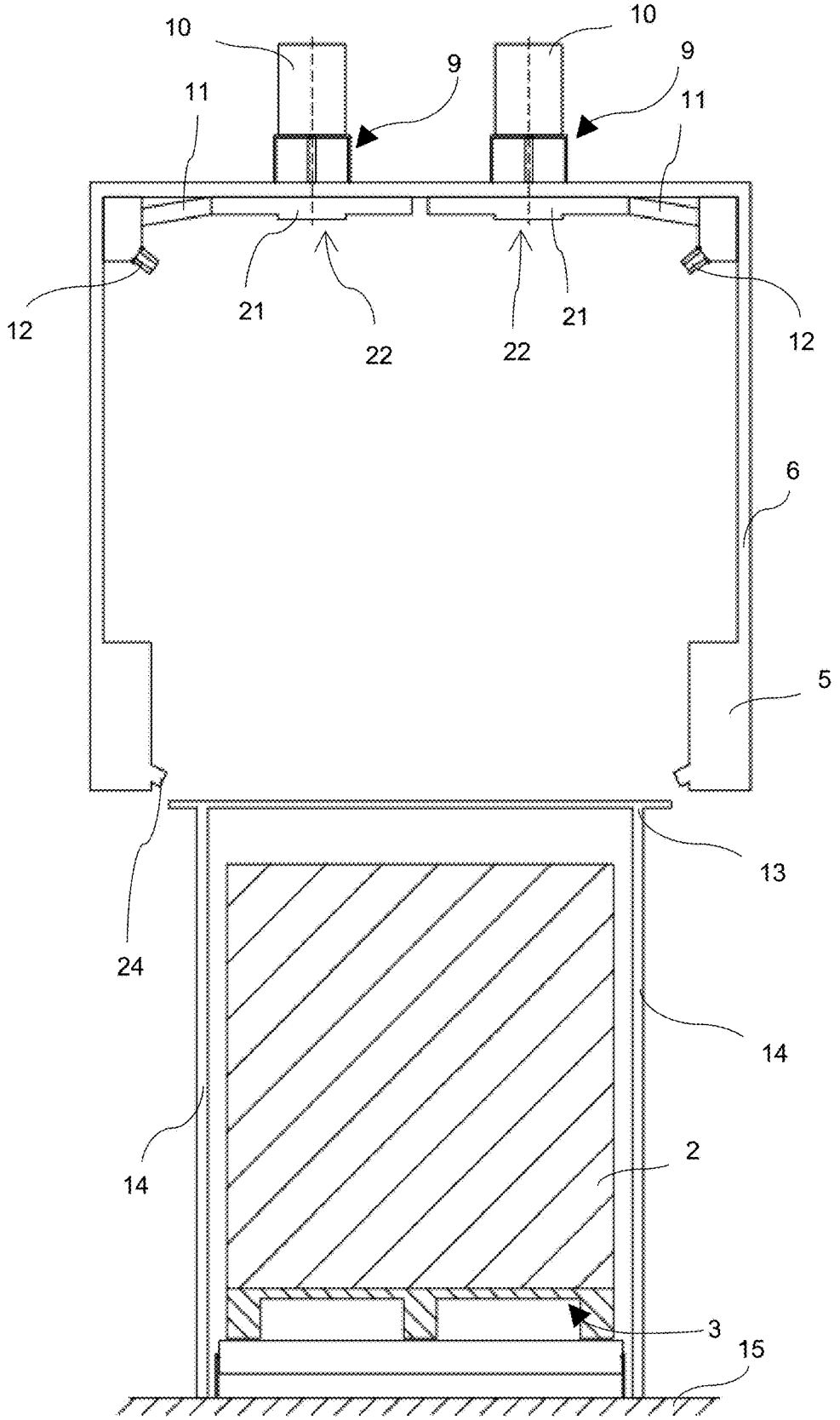

FIG. 4 shows a sectional view of a further exemplary embodiment of the inventive device 1. The device 1 shown differs from the device 1 shown in FIG. 2 only in that it includes a closure surface 13 that is adjusted with respect to its contour and its dimensions to the contour and the dimensions of the opening 19 of the shrinking frame 5. The closure surface 13 on the one hand and the shrinking frame 5 and the shrink hood 6 on the other hand are movable relative to one another. The shrinking frame 5 forms the opening 19 for the stack of goods 2 and is seen in its upper position. The closure surface 13 is located inside the opening 19 of the shrinking frame 5 and is disposed such that with increasing movement of the shrinking frame 5 into its lower position, the closure surface 13 approaches the cover 8 of the shrink hood 6.

The closure surface 13 has feet 14, its underside standing with the feet on the base 15. With respect to its contour and dimensions, the closure surface 13 is adapted to the opening 19 such that a gap still remains between the outer edge of the closure surface 13 and the inner edge of the opening 19. The closure surface 13 reduces heat loss when the shrinking frame 5 is located in its upper position. The closure surface 13 is also disposed at a height where, on the one hand, it is above the stack of goods 2, and on the other hand essentially closes off the shrinking frame 5 on its underside. Due to the closure surface 13, the opening 19 of the shrinking frame 5, and thus the shrinking space of the shrink hood 6, is nearly closed off, except in the region of the gap described above.

Figure 5:
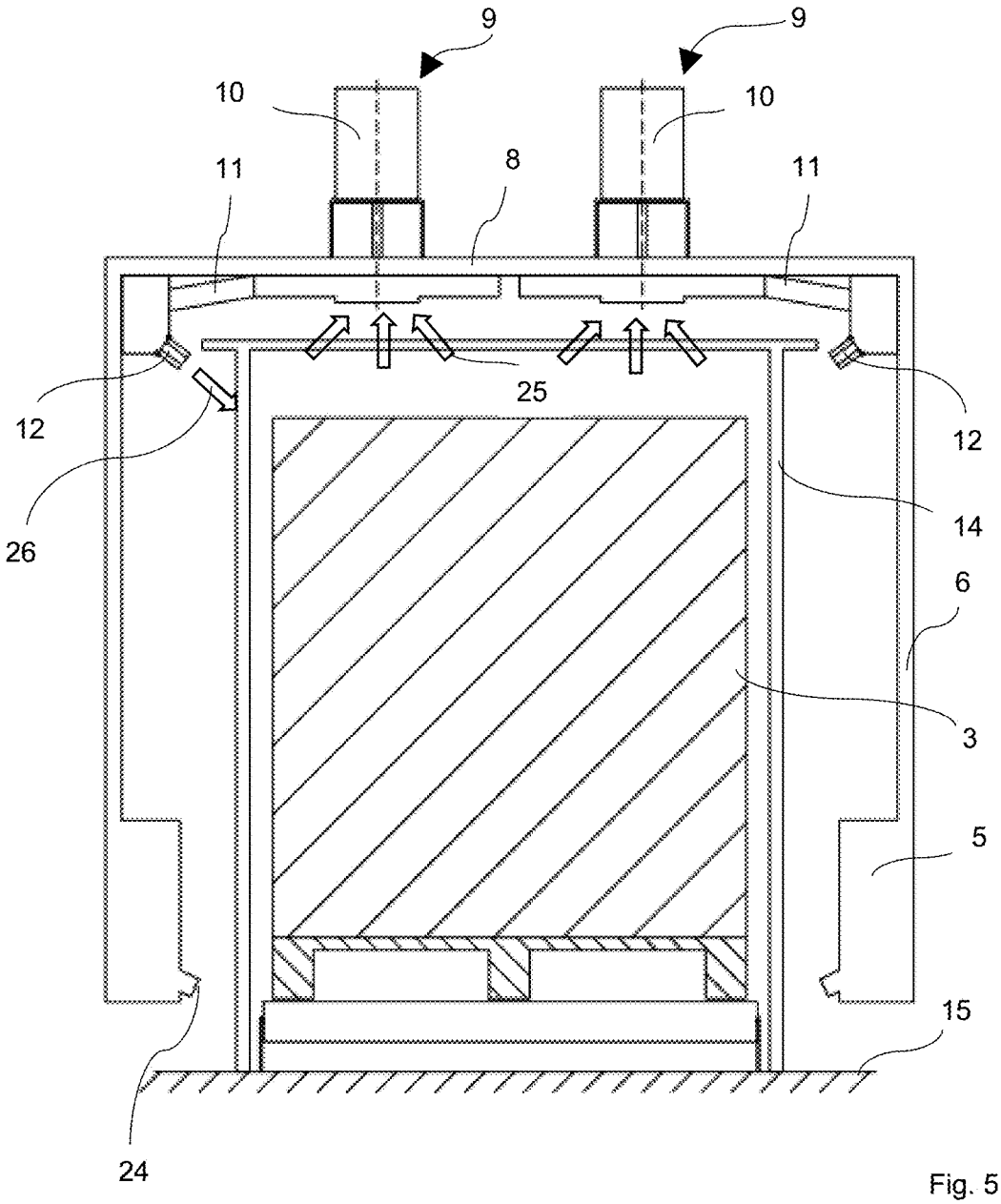

In FIG. 5, the lower edge of the shrinking frame 5 is now disposed lower than the underside of the stack of goods 2. The shrinking frame 5 has accordingly been moved from its upper position into its lower position. In the interior of the shrink hood 6, the air heated by the shrinking device shrinks the heat-shrink film 3. The two blowers 9 in turn suction air out of the upper region of the shrinking space in the interior of the shrink hood 6 in the direction of the arrows 25 and guide it via the respectively connected air-guide sections 11 to the nozzles 12. Via the nozzles 12, the warm air is reintroduced in a targeted manner in the direction of the arrows 26 into the shrinking space enclosed by the shrink hood 6. In the exemplary embodiment shown, each of the two nozzles 12 is configured as a slotted nozzle. The orientation of the slotted nozzles is such that in the lower position of the shrinking frame 5, the discharged air is blown in the direction of the arrows 26 onto the adjacent edges 17 of the stack of goods 2. Due to the lowering of the shrinking frame 5 and thus also of the shrink hood 6, the closure surface 13 has moved into the interior of the shrink hood 6. The feet 14 do not impede the airflow directed by the nozzles 12, since they are arranged such that they do not partially cover the respective slotted nozzle.

Figure 6:
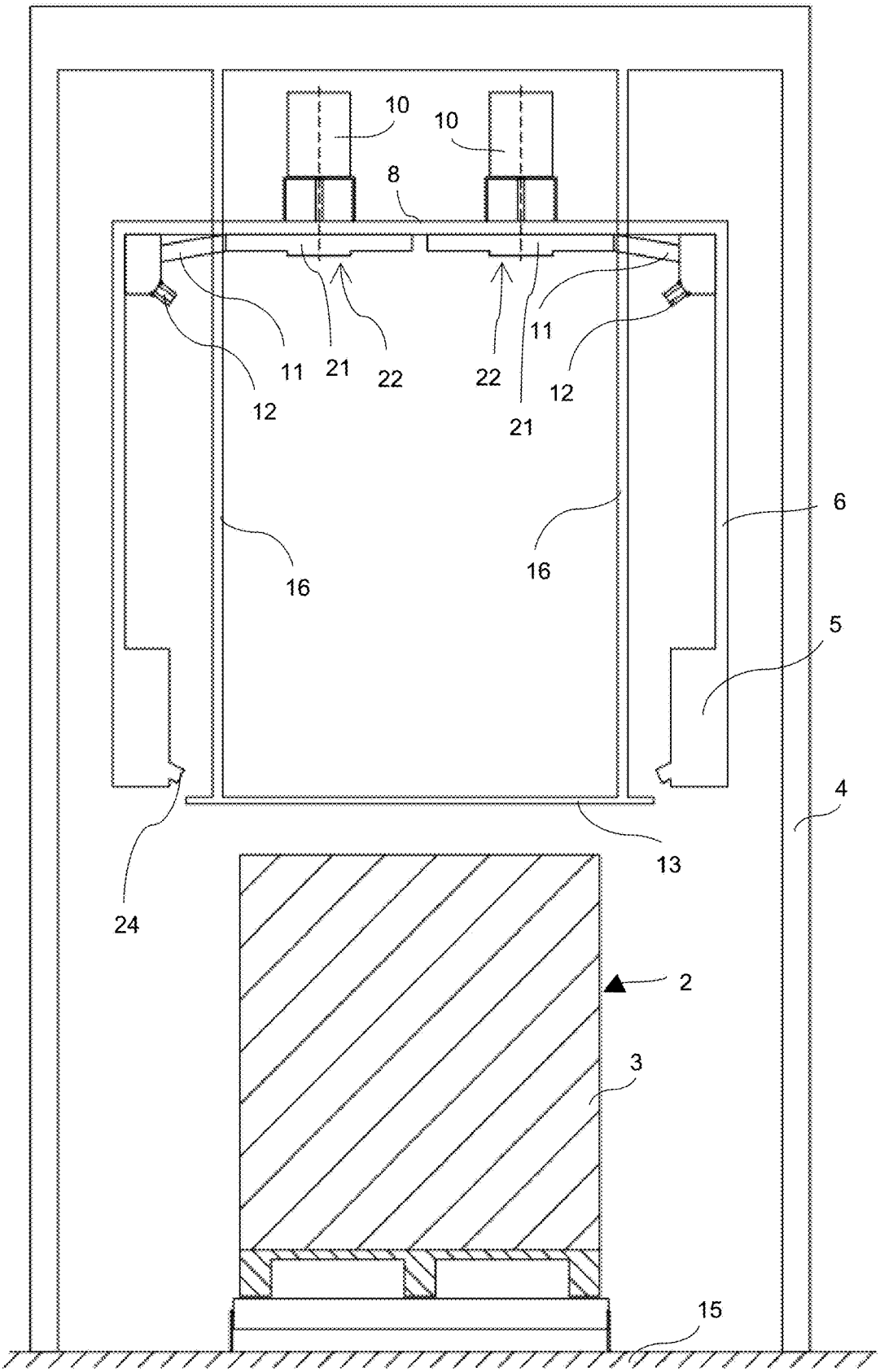

FIG. 6 shows a sectional view of a further exemplary embodiment of the inventive device 1. The device 1 shown differs in this respect from the device shown in FIG. 4 only in that the closure surface 13 is now suspended on rods 16; the rods 16 pass through the cover 8 of the shrink hood 6, and are attached to the rack 4. The rack 4 stands on the base 15. The closure surface 13 on the one hand, and the shrinking frame 5 and the shrink hood 6 on the other hand, are movable relative to one another. The shrinking frame 5 forms the opening 19 for the stack of goods 2, and is located in its upper position. The closure surface 13 is located inside the opening 19 of the shrinking frame 5 and is arranged such that with increasing movement of the shrinking frame 5 into its lower position, the closure surface 13 moves closer to the cover 8 of the shrink hood 6.

Figure 7:
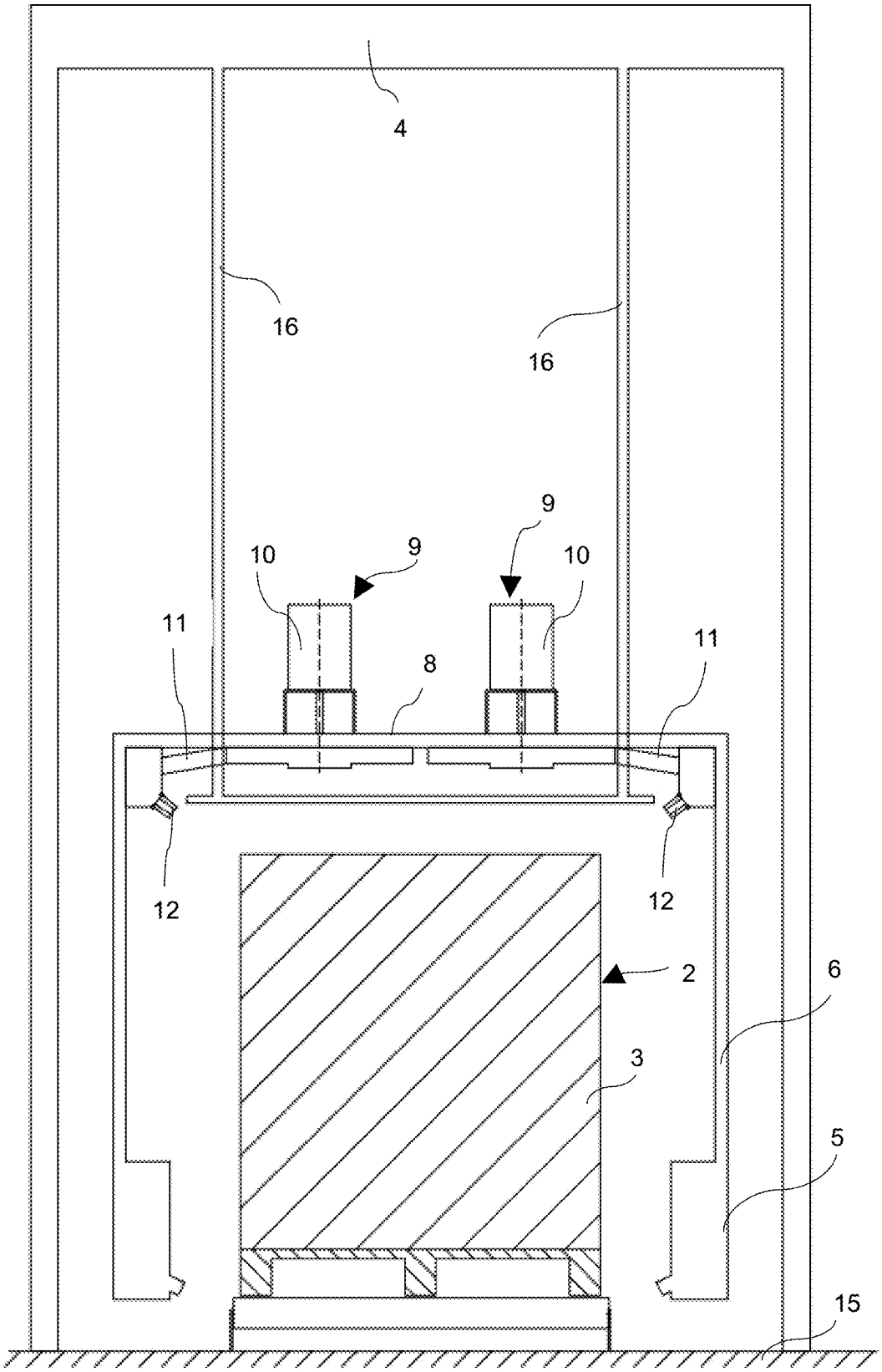

FIG. 7 shows the position in which the lower edge of the shrinking frame 5 is disposed lower than the underside of the stack of goods 2. The shrinking frame 5 has accordingly been moved from its upper position into its lower position. This is in turn the start of the shrinking process, in which the shrinking frame is moved vertically upward. In the interior of the shrink hood 6, the air heated by the shrinking device shrinks the heat-shrink film 3. The blowers 9 suction air out of the upper region of the shrinking space in the interior of the shrink hood 6 in the direction of the arrow 25 and guide it via the respectively connected air-guide section 11 to the nozzle 12. Via the respective nozzle 12, the warm air is blown again in a targeted manner in the direction of the arrows 26 into the shrinking space enclosed by the shrink hood 6. In the exemplary embodiment shown, each of the two nozzles 12 is formed as a slotted nozzle. The orientation of the slotted nozzles is such that in the lower position of the shrinking frame 5, the expelled air is blown in the direction of the arrows 26 onto the adjacent edges 17 of the stack of goods 2.

Figure 8:
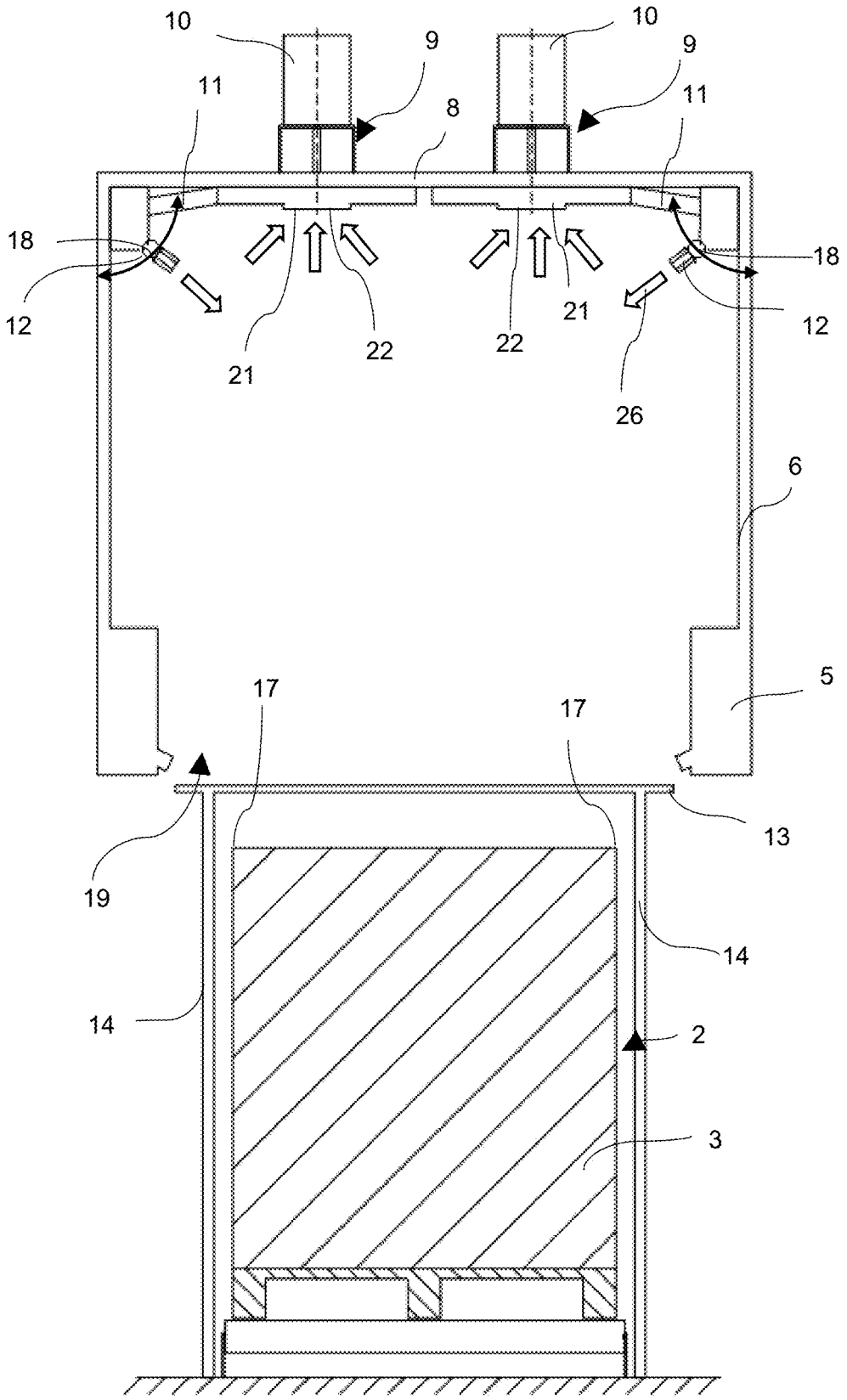

FIG. 8 shows a sectional view of an additional exemplary embodiment of the inventive device 1. The device 1 shown here differs from device 1 according to FIG. 4 only in that the nozzles 12 are disposed as swivelable about a horizontal axis 18. Each nozzle 12 can be swiveled, for example, with an electric motor that is not shown. The swiveling of each nozzle 12 enables the precise orientation of each nozzle 12 toward the respective edge 17 of a stack of goods 2. This adjustment can also take place during the vertical displacement of the shrinking frame 5. In this way, the edges 17 of stacks of goods 2 of different height can also be shrunk with optimal effectiveness.

Figure 9:
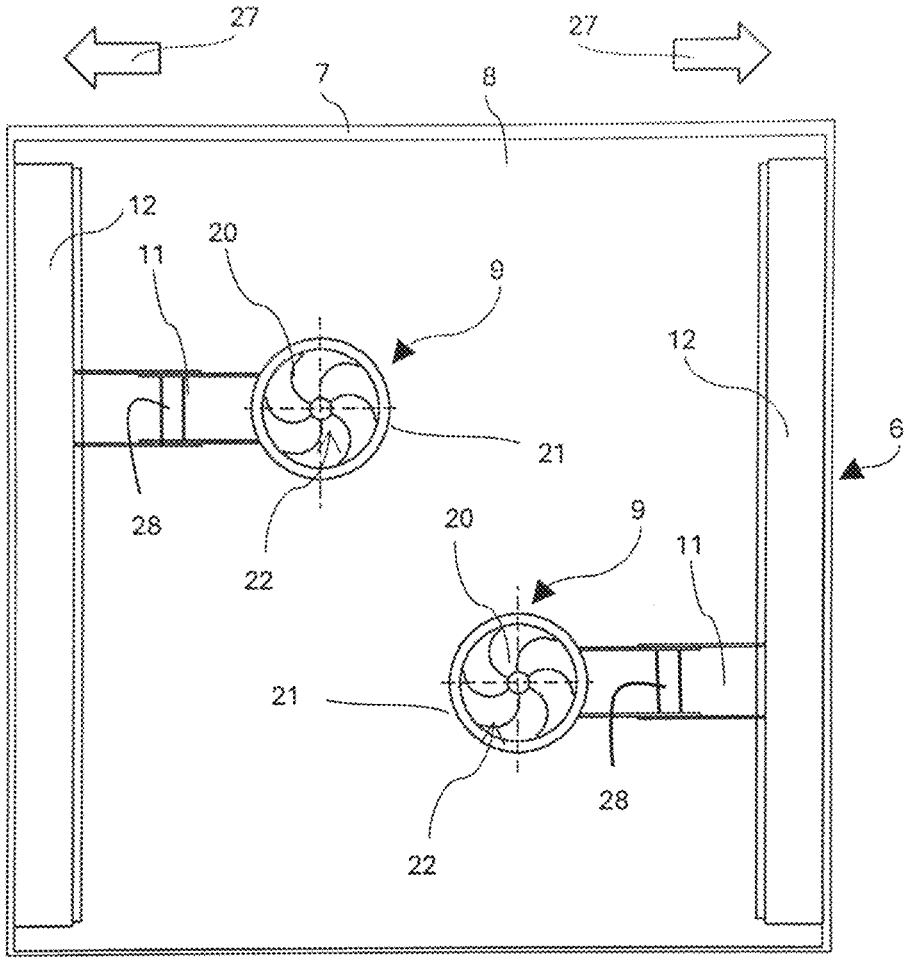
Figure 10:
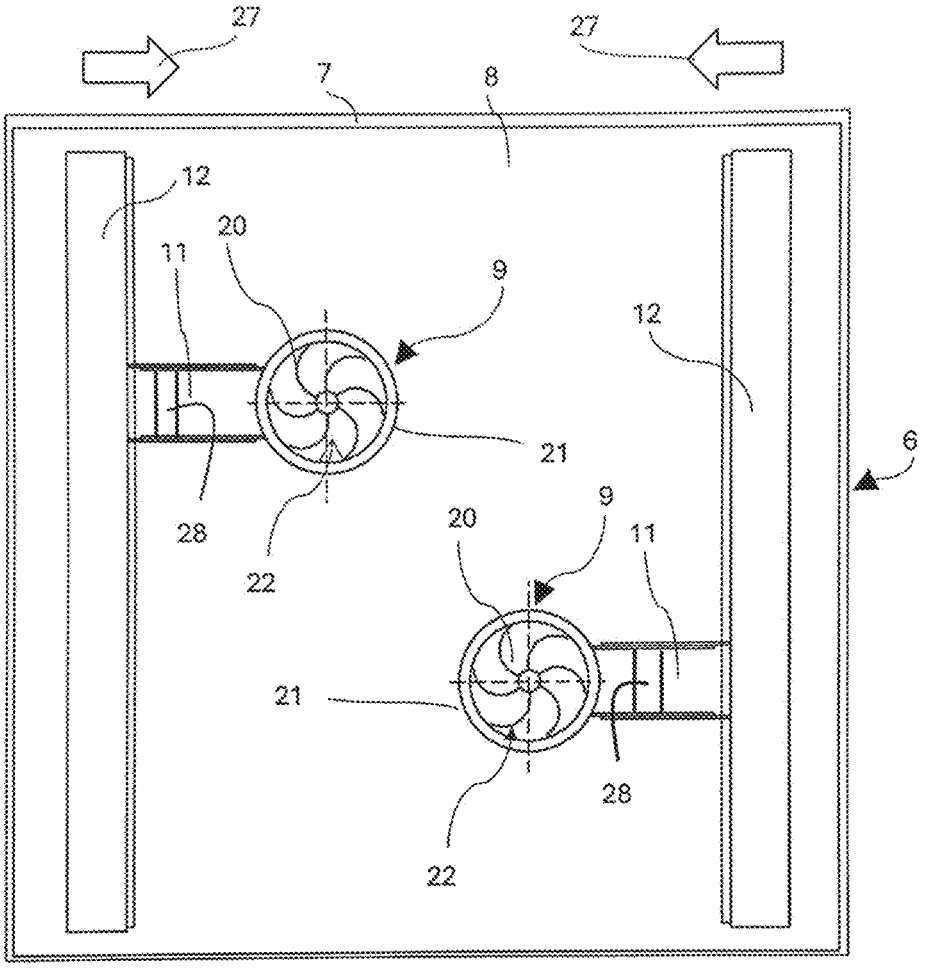

FIG. 9 shows a view of the underside of the cover 8 of the shrink hood 6. Each of the two impellers 20 is enclosed by a housing, each housing 21 having the suction intake opening 22 on its underside. The air-guide section 11 is connected to each impeller 20, that is to each housing 21 respectively. Each air-guide section 11 has the nozzle 12 on its end opposite the respective impeller 20. Each nozzle 12 is configured as a slotted nozzle. At least one heating element 28 can be provided in at least one air-guide section 11 (as best shown in FIGS. 9 and 10), and the at least one heating element 28 can heat the air flowing through the at least one air-guide section 11. Due to the heating element 28, the air flowing through this air-guide section 11 can be heated to the temperature required for shrinking. In this respect, due to the nozzle 12 connected to this air-guide section 11, air with a higher temperature than the temperature generally present in the interior of the shrink hood 6 can be guided in a targeted manner onto the heat-shrink film 3.

In FIG. 9, the distance between the two nozzles 12 is greater than in FIG. 10. This is due to the fact that in FIG. 10, the two nozzles 12 which are movable horizontally in the direction of the arrow 27, have been moved toward each other. In order to enable this movement of the nozzles 12, the length of each air-guide section 11 is variable according to the respective position of the respective nozzle 12. Thus each air-guide section 11 can be configured as telescopable, for example, Thus, despite the fixed position of an impeller 20, the corresponding nozzle 12 can be moved horizontally in the direction of the arrow 27. Thus each nozzle 12 can be optimally positioned, for example, with respect to the respective edge 17. In addition, it is also possible for each nozzle 12 to still be swivelable about a horizontal axis.

Alternatively, with one blower 9, the entire assembly comprised of the impeller 20, the housing 21 that encloses it, the air-guide section 11, and the nozzle 12 can also be designed as horizontally movable as a unit in the direction of the arrow 27.

The invention claimed is:

1. A device (1) for the shrinking of a heat-shrink film (3) placed around a stack of goods (2), with a shrinking frame (5), movable on a rack (4) in vertical direction between an upper position and a lower position, forming an opening (19) for the stack of goods (2), on which at least one shrinking device for the shrinking of the heat-shrink film (3) is provided, wherein the device (1) includes a surrounding side wall (7), forming a shrinking space, comprising a shrink hood (6) open downward, as well as a cover (8), wherein the shrink hood (6) is movable in the vertical direction, and wherein the device (1) furthermore includes at least one blower (9) that generates an air flow in the interior of the shrink hood (6), wherein the at least one blower (9) includes an impeller (20) driven by a drive (10), wherein the impeller (20) of at least one blower (9) is connected to at least one air-guide section (11), wherein the at least one air-guide section (11) is respectfully connected to at least one nozzle (12) on an end thereof opposite the impeller (20) so that the air suctioned by the impeller (20) from the shrinking space surrounded by the shrink hood (6) can be reintroduce in a directed manner via the at least one nozzle (12) into the shrinking space surrounded by the shrink hood (6).

2. The device (1) according to claim 1, wherein at least one nozzle (12) is configured as a slotted nozzle.

3. The device (1) according to claim 1, wherein at least one blower (9) is configured as a radial blower.

4. The device (1) according to claim 1, wherein the impeller (20) of at least one blower (9), and the at least one air-guide section (11) emanating therefrom, are attached below the cover (8) of the shrink hood (6), or are attached indirectly or directly to the inner side of the cover (8) of the shrink hood (6).

5. The device (1) according to claim 1, wherein in the at least one air-guide section (11), at least one heating element (28) is provided to heat the air flowing through the at least one air-guide section (11).

6. The device (1) according to claim 1, wherein the at least one blower (9) comprises the impeller (20), and wherein the at least one nozzle (12) is designed as horizontally movable.

7. The device (1) according to claim 1, wherein the at least one nozzle (12) is configured as horizontally movable, and the length of the at least one air-guide section (11) is variable according to the respective position of the at least one nozzle (12).

8. The device (1) according to claim 1, wherein the at least one nozzle (12) is vertically transportable.

9. The device (1) according to claim 1, wherein with the at least one blower (9), at least one nozzle (12) is disposed as swivelable about a horizontal axis (18).

10. The device (1) according to claim 1, wherein the device (1) has a closure surface (13) that is adapted with respect to its contour and its dimensions to the contour and the dimensions of the opening (19) of the shrinking frame (5) such that the closure surface (13) on the one hand, and the shrink hood (6) on the other hand, are movable relative to one another, wherein when the shrinking frame (5) is located in its upper position, the closure surface (13) is disposed inside the opening (19), so that with increasing movement of the shrinking frame (5) into its lower position the closure surface (13) moves closer to the cover (8) of the shrink hood (6).

11. The device (1) according to claim 1, wherein the height of the shrinking frame is at least 300 mm higher than the height of a stack of goods (2) to be packaged.

12. The device (1) according to claim 1, wherein the shrink hood (6) is connected with the shrinking frame (5).

13. The device (1) according to claim 1, wherein the impeller (20) of the at least one blower (9) is enclosed in a housing (21) including a suction intake opening (22), and wherein the at least one air-guide section (11) is connected to the housing (21).

14. A method for shrinking a heat-shrink film (3) placed around a stack of goods (2), using a device (1), with a shrinking frame (5), movable in vertical direction between an upper position and a lower position, forming an opening (19) for the stack of goods (2), on which at least one shrinking device is provided for shrinking the heat-shrink film (3) by heating, wherein the device (1) includes a surrounding side wall (7), forming a shrinking space, comprising a shrink hood (6) open downward, as well as a cover (8), wherein the shrink hood (6) is movable in vertical direction, and wherein the device (1) furthermore includes at least one blower (9) generating an air flow in the interior of the shrink hood (6), wherein the at least one blower (9) includes an impeller (20) driven by a drive (10), using the device (1), wherein on the impeller (20) of the at least one blower (9) is connected to at least one air-guide section (11), which is respectfully connected to at least one nozzle (12) on an end opposite the impeller (20) so that the air in the shrinking space enclosed by the shrink hood (6) that is suctioned out by the impeller (20) is reintroduced in a targeted via the at least one nozzle (12) into the shrinking space surrounded by the shrink hood (6).

15. The method for shrinking the heat-shrink film (3) according to claim 14, wherein the air in the shrinking space surrounded by the shrink hood (6) that is suctioned out by the impeller (20) is reintroduced in a directed manner via the at least one nozzle (12) formed as slotted nozzle into the shrinking space surrounded by the shrink hood (6).

16. The method for shrinking the heat-shrink film (3) according to claim 14, wherein the at least one blower (9) comprises the impeller (20), and wherein the air-guide section (11) and the at least one nozzle (12) are moved horizontally.

17. The method for shrinking a heat-shrink film (3) according to claim 14, wherein the at least one nozzle (12) of the at least one blower (9) is moved horizontally, and wherein the length of the at least one air-guide section (11) varies according to the respective position of the at least one nozzle (12).

18. The method for shrinking a heat-shrink film (3) according to claim 14, wherein the at least one nozzle (12) of the at least one blower (9) is moved vertically.

19. The method for shrinking a heat-shrink film (3) according to claim 14, wherein the at least one nozzle (12) of the at least one blower (9) is swivelable about a horizontal axis (18).

20. The method for shrinking a heat-shrink film (3) according to claim 14, wherein with the at least one air-guide section (11), at least one heating element (28) is provided, and the at least one heating element (28) heats the air flowing through the at least one air-guide section (11).

21. The method for shrinking a heat-shrink film (3) according to claim 14, wherein the device (1) has a closure surface (13) that is adapted with respect to its contour and its dimensions to the contour and the dimensions of the opening (19) of the shrinking frame (5) such that the closure surface (13) on the one hand, and the shrink hood (6) on the other hand, are moved relative to one another, and wherein when the shrinking frame (5) is located in its upper position, the closure surface (13) is disposed inside the opening (19), so that with increasing movement of the shrinking frame (5) into its lower position, the closure surface (13) moves closer to the cover (8) of the shrink hood (6).

22. The method for shrinking a heat-shrink film (3) according to claim 14, wherein in the lower position of the shrinking frame (5), a distance A between a top side of the stack of goods (2) and the cover (8) of the shrinking frame (6) is at least 300 mm.

23. The method for shrinking a heat-shrink film (3) according to claim 14, wherein during shrinking, the at least one nozzle (12) is directed onto the adjacent upper edge (17) of the stack of goods (2).

24. The method for shrinking a heat-shrink film (3) according to claim 14, wherein during shrinking, an air flow is directed via at least two opposing nozzles (12) onto two opposing upper edges (17) of the stack of goods (2).

25. The method for shrinking a heat-shrink film (3) according to claim 14, wherein during shrinking, the at least one nozzle (12) is set in a pendulum motion about its horizontal axis (18).

* * * * *